United States Patent [19]

Birke et al.

[11] 4,124,941

[45] Nov. 14, 1978

[54] PROCESS AND ADDITIONAL DEVICES OF CYLINDER DRYING MACHINES FOR THE UNIFORM DRYING OF TEXTILES

[75] Inventors: Walter Birke; Hans-Ulrich von der Eltz; Franz Schön, all of Frankfurt am Main, Fed. Rep. of Germany

[73] Assignee: Hoechst Aktiengesellschaft, Frankfurt am Main, Fed. Rep. of Germany

[21] Appl. No.: 722,138

[22] Filed: Sep. 10, 1976

[30] Foreign Application Priority Data

Sep. 13, 1975 [DE] Fed. Rep. of Germany ..... 2540851

[51] Int. Cl.[2] ..... F26B 3/18

[52] U.S. Cl. ..... 34/18; 34/34; 34/41; 34/114; 34/119; 34/159; 68/20

[58] Field of Search ..... 34/114, 23, 222, 229, 34/159, 68, 54, 41, 18, 34, 119, 124; 68/5 C, 5 D, 20

[56] References Cited

U.S. PATENT DOCUMENTS

| | | | |
|---|---|---|---|
| 3,052,991 | 9/1962 | Goldner | 34/114 |
| 3,416,237 | 12/1968 | Sutherland et al. | 34/54 |
| 3,576,078 | 4/1971 | Holt | 34/159 |

*Primary Examiner*—John J. Camby
*Assistant Examiner*—Larry I. Schwartz
*Attorney, Agent, or Firm*—Curtis, Morris & Safford

[57] ABSTRACT

Process for promoting uniform and low levels of migration in drying of moist textile webs impregnated with treating agents using cylinder drying machines, by removing the vapor layer formed on the reverse surface of the textile web not contacting the heated cylinders during the continuous passage of the web through the heat transfer zone by suction or transverse blowing over the width of the web. Devices for carrying out this process are described.

10 Claims, 2 Drawing Figures

Figure 1:
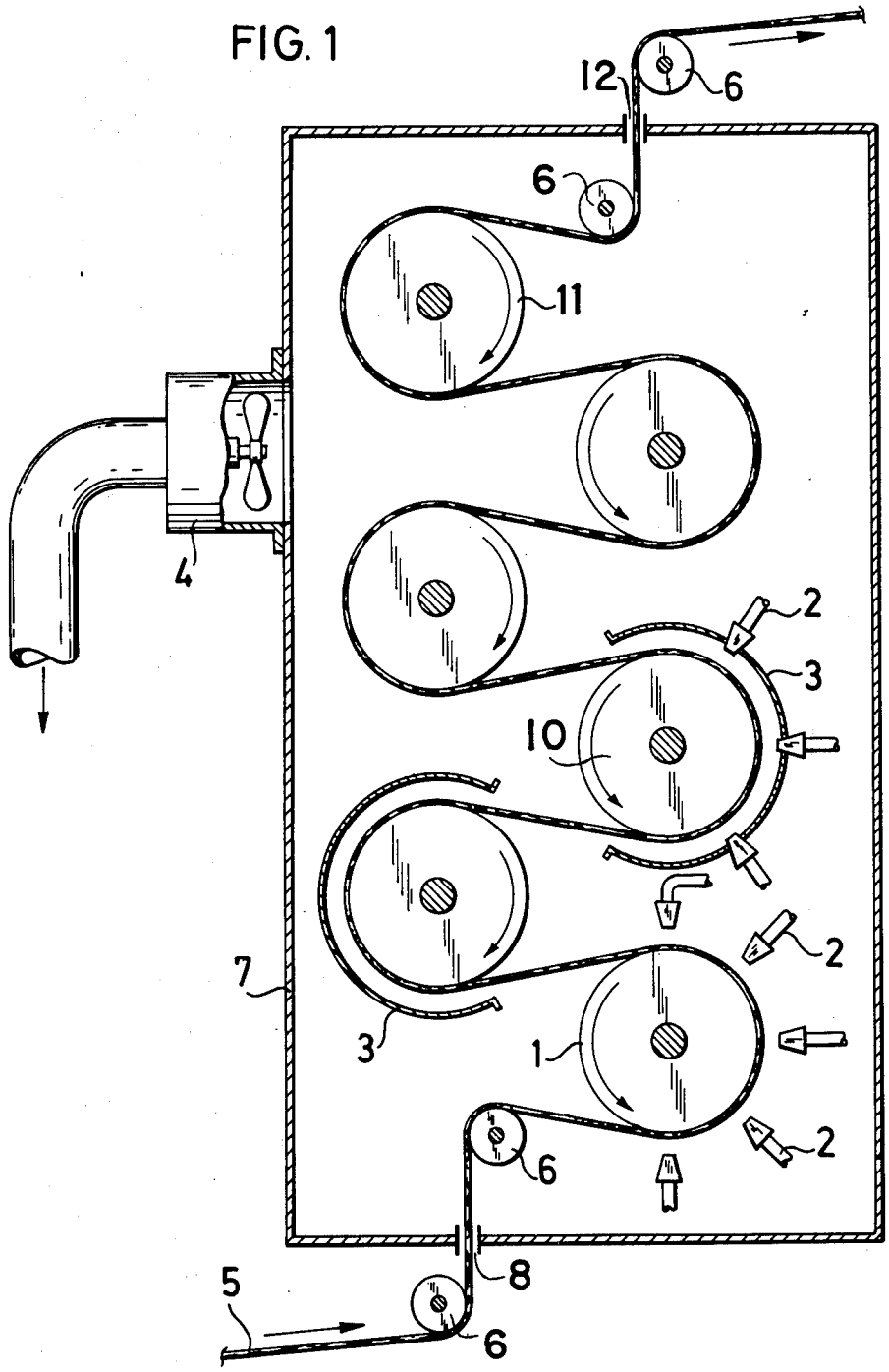

PROCESS AND ADDITIONAL DEVICES OF CYLINDER DRYING MACHINES FOR THE UNIFORM DRYING OF TEXTILES

In continuous dyeing and finishing processes, various drying processes and drying machines are known for drying textile materials. There are, for example, drying processes using hot air, infrared radiation, microwaves, as well as contact or combustion drying processes. Known drying machines in connection with these processes are IR predryers, hotflues, tenters, cylinder dryers, perforated drum dryers or drying plants in accordance with the burning-off technique.

In cylinder drying machines, the textile material in the form of a web turns around parts of the cylinders present, either on one side only or alternatingly on both sides. When the material turns unilaterally around the drums, a migration-free drying of the dyestuff is not possible. However, by alternating turns of the web around the drying drums, an acceptable dyestuff migration is obtained if the temperatures of the cylinder surface and the contact time of the textile material with each cylinder are carefully adjusted. Also, if the textile material, before contacting it with the hot cylinder, is already partially dried, for example in an IR predryer, so that it contains only a certain residual humidity, migration of the dyestuff can be almost completely prevented. In order to increase the drying performance of cylinder drying machines, the vapor which has formed is removed from the surface of the fabric in certain cases by lateral blowing from the ends of the cylinders. However, this method may cause uncontollable dyestuff migration.

As has been observed in laboratory and practical tests, dyestuffs migration due to the drying of dyestuff pads by means of cylinder dryers depends to a very large extent on the kind of fibers and the structure of the fabric, and to a certain degree also on the kind and amount of dyestuff used. For example, cotton fabrics have a behavior on contact dryng which differs entirely from that of fabrics made of polyester fibers. Thus, on unilateral contact drying of cotton poplin fabrics in cylinder drying machines, the dyestuff migrates from the contact side of the fabric to the side which is not contacted with the drying cylinders. In the case of polyester staple fiber fabrics, however, or of fabrics made from textured polyester fibers, the dyestuff migrates in opposite direction, i.e. to the surface of contact.

It has now been found that the migration of dyestuffs, finishing agents or auxiliaries in the case of synthetic fibers, is caused to occur in the opposite direction to that indicated above by a more or less rapid and thorough removal of the vapor layer which has formed in the contact drying of textiles and which is not disturbed by turbulences.

The subject of the present invention is a process for promoting uniform and low levels of migration in drying of moist textiles in the form of a web, impregnated with treating agents and made from synthetic fibers or mixtures thereof with natural fibers, in cylinder drying machines; which comprises removing the vapor layer formed on the reverse surface of the textile web not contacting the heated cylinders during the continuous passage of the web through the heat transfer zone by suction or transverse blowing over the width of the web.

According to this invention and in contrast to prior processes, blowing with cold or, preferably, hot air is carried out in such a manner that the textile material is treated on the reverse of the contact surface with variable air rates or speeds hitting the web preferably in vertical direction. The air rate or air speed depends on the kind of fiber and on the structure of the fabric. By variation of the air temperature, the temperature of the cylinder surface and the speed of the web, the dyestuff migration may be further controlled to the intended extent.

The present invention relates also to additional devices for cylinder drying machines of known design in order to carry out the above process, which comprise nozzles for blowing air or for exhausting vapor being mounted at a variable distance to the level of the travelling textile web over the width of at least part of the drying cylinders present. Because of their special design, these devices of the present invention allow a low level or small amount of migration in drying.

A drying machine in accordance with this invention should possess the following special construction elements:

1. continuously variable operation speed
2. unilateral or bilateral feed of the textile material
3. nozzles for blowing air or exhausting vapors adjustable with respect to distance and direction of the fabric and optionally also transversally over the width of the web
4. variable amount, temperature and speed of air within the nozzle system
5. variable temperature of the cylinder surfaces
6. air guidance around the drying cylinders by means of baffle plates
7. adjustable exhaust of the drying plant.

The baffle plates around the drying cylinders serve not only for an exact guidance of the air current formed by suction or blowing but also ensure that the vapor generated over the surface of the fabric in the drying operation will be only slightly disturbed or removed very slowly, if necessary.

It is not necessary that the above-mentioned devices be utilized on all cylinders of the entire drying plant. For example, the last drums of the plant where the final drying of the web occurs and consequently migration of dyestuff is no longer to be expected need not be provided with these additional devices.

Figure 2:
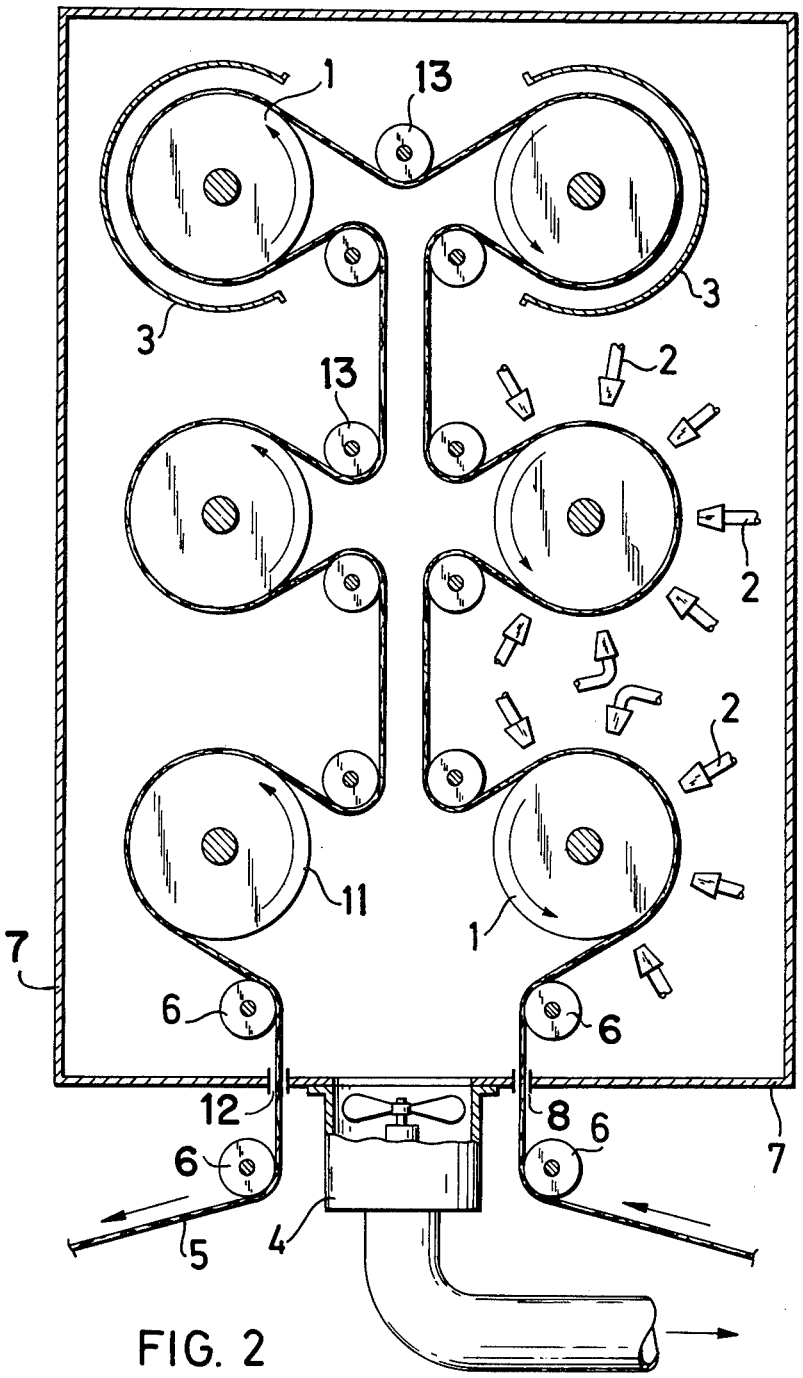

The present invention will be better understood by reference to the accompanying drawings, in which FIG. 1 represents a schematic view of a cylinder drying machine for bilateral transport of textile material, provided with the additional devices according to this invention, and FIG. 2 represents a schematic view of a similar machine, also provided with the additional devices according to the invention, but designed for unilateral transport of textile material.

Referring to FIG. 1, the web 5 is fed around guide rollers 6 into the cylinder drying machine through the opening 8 in the casing 7. The web passes around the heated drying cylinder 1 in the direction indicated by the arrow. As one surface of the web passes around cylinder 1, the nozzles 2 which can be located at various heights above the surface of the web, blow or suction air at various velocities and temperatures across the width of the web surface which is not in contact with the cylinder. Although not shown in the FIGURE, the nozzles can be mounted such that they are mobile in a direction transverse to the direction of movement of the web 5. The web passes around successive cylinders such that each successive cylinder contacts an alternate surface of the web, until the web passes around the last heated drying cylinder, 11 and guide roller 6 and passes out of the drying machine through the opening 12 in the casing 7. The heated drying cylinders can be provided with baffle plates 3 and the nozzles 2 can be mounted within the plates 3 (as shown above cylinder 10). The baffle plates 3 provide air guidance around the drying cylinders. The casing is provided with an exhaust 4 for ventilating the casing.

Referring to FIG. 2, the web 5 is fed into and passes through the drying machine in the same manner described in FIG. 1 except that the drying machine is provided with additional guide rollers 13 positioned between the heated drying cylinders. The additional guide rollers cause successive cylinders to contact the same side of the web.

What is claimed is:

1. A method for controlling migration of a treating agent in drying a moist textile in a cylinder drying machine, said drying machine having a heated drying cylinder and said textile being in the form of a structured fiber web being made of a synthetic fiber or a blend of synthetic and natural fiber and being impregnated with the treating agent that remains permanently in the web after drying, said method comprising the steps of continuously passing the web over the heated drying cylinder said drying cylinder being heated to a temperature high enough to cause the formation of a vapor layer on the surface of the web opposite the surface of the web in contact with the heated drying cylinder and simultaneously removing the vapor layer at a rate which varies with the fiber and structure of the textile web to ensure controlled levels of migration of the treating agent.

2. The method, as claimed in claim 1, wherein said removing step comprises blowing a gas onto the surface of the web opposite the surface in contact with the heated cylinder.

3. The method, as claimed in claim 2, wherein said blowing step comprises blowing a gas at varying velocities.

4. The method, as claimed in claim 2, wherein said blowing step comprises blowing a gas over at least part of the width of the web.

5. The method, as claimed in claim 2, wherein said blowing step comprises blowing a gas in a direction substantially perpendicular to the surface of the web.

6. The method, as claimed in claim 2, wherein said blowing step comprises blowing hot air.

7. The method, as claimed in claim 1, wherein said removing step comprises applying suction to the surface of the web opposite the surface in contact with the heated cylinder.

8. The method, as claimed in claim 7, wherein said suction is applied at varying rates.

9. The method, as claimed in claim 7, wherein said suction is applied over at least a part of the width of the web.

10. The method, as claimed in claim 7, wherein said suction is applied in a direction substantially perpendicular to the surface of the web.

* * * * *